United States Patent [19]

Kubo

[11] Patent Number: 4,719,673

[45] Date of Patent: Jan. 19, 1988

[54] LOCKABLE SLIDER FOR SLIDE FASTENERS

[75] Inventor: Yasutoshi Kubo, Macon, Ga.

[73] Assignee: Yoshida Kogyo K. K., Tokyo, Japan

[21] Appl. No.: 15,225

[22] Filed: Feb. 17, 1987

[30] Foreign Application Priority Data

Feb. 17, 1986 [JP] Japan ..... 61-21725[U]
May 23, 1986 [JP] Japan ..... 61-78739[U]

[51] Int. Cl.[4] ..... A44B 19/30
[52] U.S. Cl. ..... 24/421; 24/419
[58] Field of Search ..... 24/421, 419, 437, 422, 24/424, 425, 429

[56] References Cited

U.S. PATENT DOCUMENTS

| | | | |
|---|---|---|---|
| 2,373,523 | 4/1945 | Winterhalter . | |
| 2,571,024 | 10/1951 | Feitl . | |
| 2,737,699 | 3/1956 | Erdmann | 24/421 |
| 2,978,773 | 4/1961 | Erdmann | 24/419 |
| 3,018,534 | 1/1962 | Huelster | 24/419 |
| 3,320,645 | 5/1967 | Burbank | 24/421 |
| 3,508,304 | 4/1970 | Burbank | 24/421 |
| 4,130,918 | 12/1978 | Ishii et al. | 24/419 |
| 4,137,609 | 2/1979 | Kedzierski | 24/419 |
| 4,271,567 | 6/1981 | Aoki | 24/421 |
| 4,422,220 | 12/1983 | Oda | 24/421 |
| 4,644,613 | 2/1987 | Kedzierski | 24/421 |

*Primary Examiner*—Victor N. Sakran
*Attorney, Agent, or Firm*—Hill, Van Santen, Steadman & Simpson

[57] ABSTRACT

An automatic lock slider for a slide fastener provided with discrete coupling elements includes a locking prong which is movable into and out of a guide passage in the slider. The prong has a cam surface downwardly canted at an angle of 20°-30° which represents the critical point at which the coupling elements would otherwise become displaced or dislodged when subjected to stresses tending to spread apart the fastener chain, and the cam surface initiates at a position above the upper end surface of the coupling element. This arrangement facilitates passage of the fastener chain underneath the locking prong without marring the coupling elements when external forces are exerted on the fastener chain.

4 Claims, 9 Drawing Figures

LOCKABLE SLIDER FOR SLIDE FASTENERS

BACKGROUND OF THE INVENTION

1. Field of the Invention

This invention relates to sliders for slide fasteners provided with discrete coupling elements and particularly to such a slider which has means of automatically locking the same against movement.

2. Related Art

A conventional slider of the automatic lock type is typically provided with a pull tab and a spring-actuated locking prong operatively associated therewith such that upward tilting of the pull tab lifts and releases the locking prong from engagement with the coupling elements of the slide fastener, and bringing the pull tab back in a position parallel with the slider body urges the locking prong down into the path of the coupling elements to lock the slider against any movement. Design considerations have been given such that the slider has on one hand a lock function in which the locking prong penetrates in between and locks adjacent coupling elements against movement under and up to a predetermined amount of pressure, and on the other hand a ratchet function in which with greater pressures the locking prong ascends and allows the coupling elements to move underneath and past the locking prong. The maximum allowable lock strength of the locking prong is defined by a critical pressure at which the coupling elements begin to shift out of position on the fastener or otherwise sustain damage. Certain structural features have been proposed, whereby the coupling elements when subjected to a pressure beyond the critical point are allowed to move, while being tilted, past and underneath and clear the locking prong without suffering physical damage. This device has a vertically extending locking surface and a canted cam surface contiguous thereto and includes a cavity in the bottom wall of the slider in confronting relation to the locking prong, the cavity being progressively reduced in depth toward the position of the diamond head to provide an upwardly slanted cam surface. Such device can perform the necessary lock and ratchet functions provided that a predetermined length of the locking surface and a predetermined angle of the canted cam surface are accurately maintained. However, the length of the locking surface is determined by the dimensional relations between a slider guide channel, a locking prong and coupling elements. The amount of ingress of the locking prong into the guide channel is variable considerably with dimensional errors resulting from aggregated tolerances in the finish of locking prong, guide channel and coupling elements or in the chamfering of coupling elements, should individual tolerances of these parts be small even below point mm. All these dimensional errors when added up would result in unduly strong lock function or conversely in greater ratchet function or reduced lock effect. This means that an extremely high degree of accuracy is required for the finished parts dimensions.

SUMMARY OF THE INVENTION

With the foregoing difficulties of the prior art in view, the present invention is aimed at the provision of an automatic lock slider for a slide fastener which is capable of accurate and smooth lock and ratchet performance with greater dimensional tolerances of the slider parts.

To this end, a slide fastener slider according to the invention has a locking prong releasably engageable with coupling elements on the fastener and normally having an effective locking surface commencing at a position above the upper end surface of the coupling element and canting downwardly at a predetermined angle with respect to the plane of the slider.

The present invention will be more apparent from the following description taken in conjunction with the accompanying drawings which illustrate a preferred embodiment of the invention and in which like reference numerals refer to like and corresponding parts throughout the several views.

DESCRIPTION OF THE PREFERRED EMBODIMENT

Figure 1:
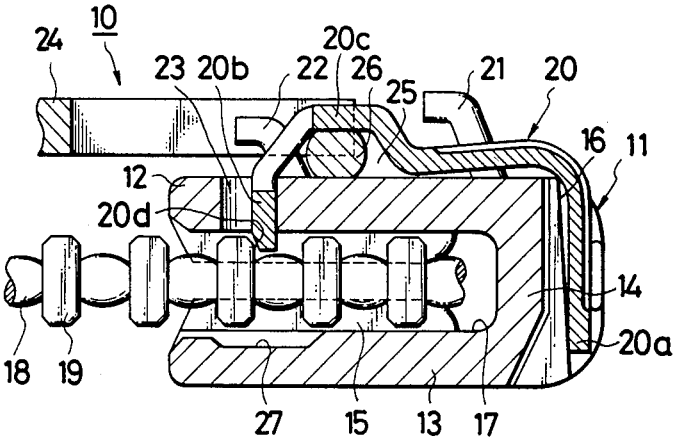
FIG. 1 is a longitudinal cross-sectional view of a slider embodying the invention mounted on a slide fastener chain.

Referring now to the drawings and FIG. 1 in particular, there is shown in longitudinal cross-section an automatic lock slider generally designated at 10 for use on a slide fastener. The slider 10 has a slider body 11 which includes upper and lower spaced parallel wings 12 and 13 which are joined at their front ends by a connecting neck 14 commonly known as a diamond head. The upper and lower wings 12, 13 are generally similar in shape and inwardly flanged along their lateral side edges as at 15. Formed in and extending vertically through the connecting neck 14 is a retention groove 16 for receiving one end of a spring locking member 20 later described.

The upper and lower wings 12 and 13 of the slider 10 define therebetween a generally Y-shaped guide channel 17 for the passage therethrough of a pair of stringers each including a support tape 18 and a row of coupling elements 19 of a discrete formation.

Formed on the upper surface of the upper wing 12 adjacent to the neck 14 is a first retaining lug 21 which holds the locking member 20 in place against lateral movement. A second retaining lug 22 is formed likewise on the upper wing 12 adjacent to an aperture 23 communicating with the guide channel 17 and is adapted to restrict ascending movement of the free end of the locking member 20 which functions as a locking prong hereafter described.

The locking member 20 is made of a resilient material as a whole, and it has a downwardly curved end **20*a* receiving and anchored in the retention groove 16 and a straight vertically depending free end which serves as a locking prong 20*b* resiliently movable through the aperture 23 into and out of the guide channel 17. The locking prong 20*b* is brought into and out of engagement with the coupling elements 19 in the guide channel normally by manipulation of a pull tab 24 in a well known manner. The locking prong 20b is adapted to penetrate into a space between an adjacent pair of the discrete coupling elements 19. The locking prong 20 includes a bulged support portion 20c adjoining the prong 20b, the bulged portion 20c defining with the upper surface of the upper wing 12 a lateral bore 25 for pivotally receiving a spindle 26 of the pull tab 24. The spindle 26 has a peripheral cam surface for operatively engaging the bulged portion 20c**.

The general construction and operation of the automatic lock slider 10 as above described is conventional, and hence no further explanation will be required.

Figure 2:
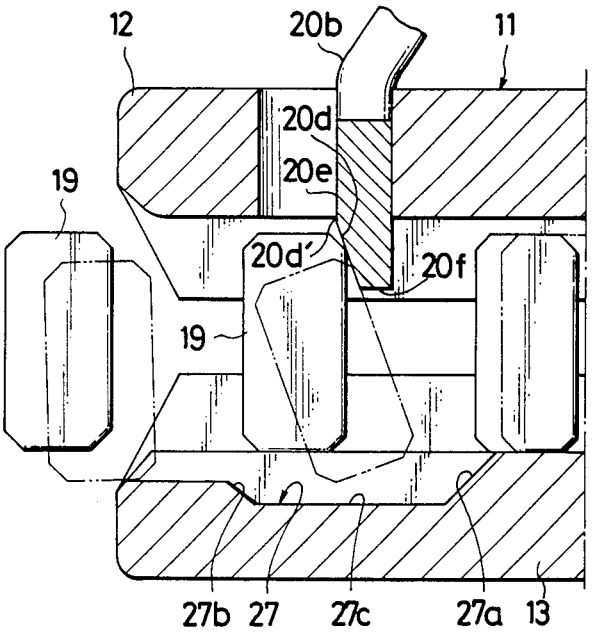
FIG. 2 is a schematic side elevational view on enlarged scale of a portion of the slider of FIG. 1, illustrating the operative relationship between the locking prong and the fastener coupling elements.

Now, according to an important aspect of the present invention, the locking prong 20b is provided at its outer rear portion with a locking cam surface 20d extending from the vertical surface 20e to a horizontal end surface 20f at a canted angle of 20°-30°, this being 20° in the case of FIG. 2.

The angle in the range of 20°-30° at which the locking cam surface 20d assumes with respect to a plane perpendicular to the plane of the slider 10 is consistant with the angle at which the coupling elements 19 on the fastener can tilt and sink without becoming displaced or dislodged. It has been found that smaller angles than 20° for the locking surface 20d would result in insufficient force for the coupling elements 19 to lift the locking prong 20b, or explained otherwise, in unduly increased locking strength prohibiting the coupling elements 19 to tilt and sink to a desired extent. Greater locking surface angles than 30° would result in unduly reduced locking strength, or explained otherwise, in increased ratchet function or increased tendency to lift the locking prong 20b. Also importantly, in normal locking position of the locking prong 20b, the locking cam surface 20d has its upper end point 20d' located slightly above the upper end surface of the coupling element 19.

There is provided a cavity 27 in the inner or upper surface of the lower wing 13 in confronting relation to the aperture 23, the cavity opening to the guide channel 17 and being defined by sloped surfaces 27a and 27b on opposite ends of a flat bottom surface 27c.

Forces directly exerted on the fastener chain to spread apart the same urge the coupling element 19 to tilt in abutting engagement with the locking prong 20b and sink into the cavity 27. This dual movement of the coupling element 19 is effected by the presence of forces or stresses barely reaching or immediately premature of the critical point of a slider lock strength at which the coupling element 19 would be shifted out of position or separated from the support tape 18. The critical angle at which the coupling element 19 can tilt at once and sink or descend is normally 20°-30°.

Figure 3:
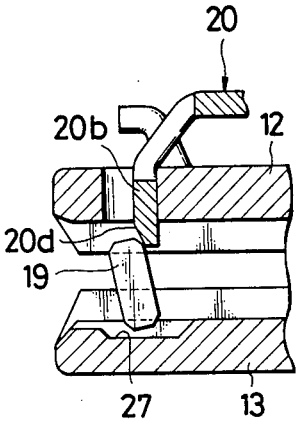
FIGS. 3–6 inclusive are longitudinal cross-sectional views of a rear portion of the slider in FIG. 1, illustrating the behavior of the coupling element in progression.
Figure 4:
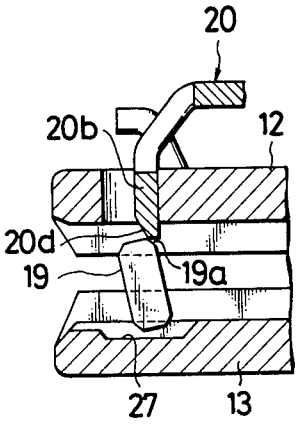
Figure 5:
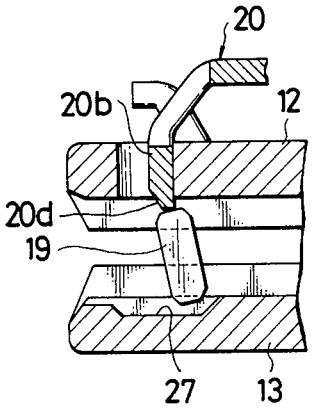
Figure 6:
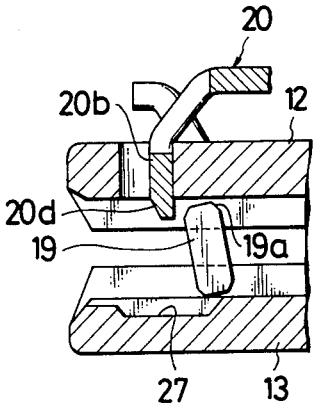

The behavior or the above dual movement of the coupling element 19 in contact with the locking prong 20b is illustrated in FIGS. 3-6 inclusive, in which the coupling element 19 initially in locked position begins to tilt and sink under the influence of external pressures upon the fastener chain as the upper front corner 19a of the element 19 slides down along the locking cam surface 20d of the locking prong 20b. The cam surface 20d serves not only to permit the coupling element 19 to tilt as shown in FIGS. 3 and 4 but also to lift the locking prong 20b in contact with the coupling element 19 against spring tension in the locking member 20 as shown in FIG. 5. The coupling element 19 continues to advance in sliding contact with the locking prong 20b until the upper rear corner 19b of the element 19 reaches the rear end corner of the locking prong 20b, at which time the coupling element 19 is in effect released from the locking prong 20b and thereafter guided up along the upgrade cam surface 27a of the cavity 27 back onto a regular track in the guide channel 17 as shown in FIG. 6. If it were not for the upgrade cam surface 27a, the coupling element 19 would stand upright during forward travel and end up in getting jammed against the frontal cavity wall.

Figure 7:
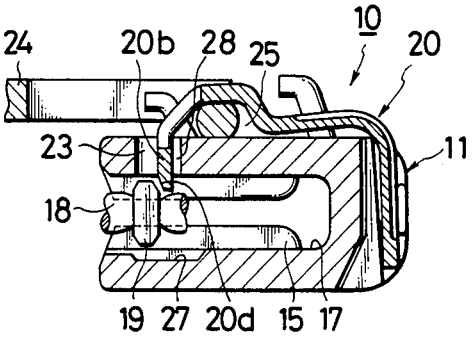
FIG. 7–9 inclusive are longitudinal cross-sectional views of a modified form of the slider in FIG. 1.
Figure 8:
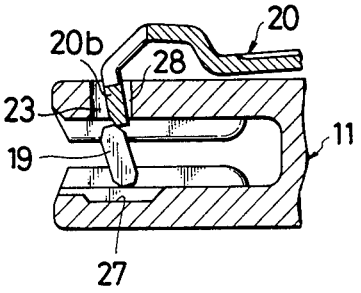
Figure 9:
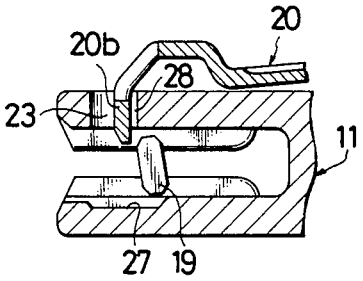

FIGS. 7-9, inclusive, show a modified form of slider according to the invention in which the locking prong 20b in its normal locking position is disposed in spaced apart relation to the peripheral wall of the aperture 23 which confronts the rear vertical portion of the locking prong 20b. The locking prong 20b is thus spaced from the wall of the aperture 23 across a gap 28 which is proven experimentally to be preferably about 0.2 mm. The provision of the gap 28 allows the locking prong 20b to flex by resiliency of the locking member 20 counterclockwise in the direction of the diamond 14 as pressures are applied to the fastener to cause the coupling elements 19 to lean or tilt and sink in the cavity 27 as shown in FIG. 8, until the prong 20b restores its upright position upon departure from the coupling elements 19 as shown in FIG. 9. This flexing movement of the locking prong 20b is proven experimentally to save approximately 1 kg. of load upon the coupling elements 19 as compared to the case where the locking prong 20b is disposed normally in abutting relation to the peripheral wall of the aperture 23 as shown in the embodiment of FIG. 1 and thus literally facilitates ascending motion of the locking prong 20b.

Although various minor modifications may be suggested by those versed in the art, it should be understood that I with to embody within the scope of the patent warranted hereon, all such embodiments as reasonably and properly come within the scope of my contribution to the art.

What is claimed is:

1. An automatic lock slider for a slide fastener having a slide fastener chain provided with coupling elements comprising:

(a) a slider body including upper and lower wings spaced parallel to each other and joined together at their front ends to define a guide channel therebetween for a regular track of the slide fastener chain;

(b) a pull tab pivotally mounted on the slider body;

(c) a locking member supported on the slider body and including a locking prong movable through an aperture into and out of the guide channel;

(d) said lower wing having a cavity disposed in its inner surface contiguous to said guide channel in confronting relation to said prong to allow said coupling element to sink therein, said cavity having an upgrade cam surface extending toward the front ends of said wings such that when an external separating force is applied to the fastener chain with said locking prong disposed outside the guide channel, the coupling element disposed underneath said locking prong is moved past the locking prong through said cavity and then guided up along said upgrade cam surface back onto the regular track in the guide channel; and (e) said locking prong having a cam surface downwardly canted at an angle consistent with an angle at which said coupling elements tilt under stresses barely reaching the critical point at which said coupling elements become displaced or separated, said locking prong having an effective cam surface commencing at a position above the upper end surface of said coupling element.

2. An automatic lock slider according to claim 1, said cam surface being canted at an angle of 20°-30°.

3. An automatic lock slider according to claim 1, said locking prong in its normal locking position having its rear portion spaced by a gap from the peripheral wall of said aperture.

4. An automatic lock slider according to claim 3, said gap being approximately 0.2 mm.

* * * * *